US006356730B1

(12) United States Patent
Nonaka

(10) Patent No.: US 6,356,730 B1
(45) Date of Patent: Mar. 12, 2002

(54) DEVELOPING APPARATUS AND CLEANING APPARATUS

(75) Inventor: Fumito Nonaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/599,952

(22) Filed: Jun. 23, 2000

(30) Foreign Application Priority Data

Jun. 24, 1999 (JP) ..... 11-178969

(51) Int. Cl.[7] ..... G03G 15/06; G03G 21/00

(52) U.S. Cl. ..... 399/284; 15/256.5; 399/251; 399/274

(58) Field of Search ..... 399/274, 284, 399/350, 351, 126; 118/261; 15/256.5; 411/116, 147

(56) References Cited

U.S. PATENT DOCUMENTS 4,548,490 A * 10/1985 Stirrat et al. ..... 399/274 X
5,812,918 A * 9/1998 Nakaue et al. ..... 399/284
6,282,395 B1 * 8/2001 Nittani et al. ..... 399/284

FOREIGN PATENT DOCUMENTS

JP 01-219859 * 9/1989
JP 06-130877 * 5/1994

* cited by examiner

*Primary Examiner*—Sophia S. Chen
(74) *Attorney, Agent, or Firm*—Fitzpatrick, Cella, Harper & Scinto

(57) ABSTRACT

The present invention relates to a developing apparatus, including: a developing agent carrier for carrying a developing agent to develop an electrostatic latent image formed on an image carrier with the developing agent; a regulating member for regulating a thickness of a layer of the developing agent carried by the developing agent carrier; and a securing member, provided with an engaging hole for engaging with an axis, for securing the regulating member to a main body of the developing apparatus. The securing member is provided with a cutting portion formed around the engaging hole so as to be able to absorb, in a longitudinal direction of the regulating member, a difference between elongation and contraction of the regulating member and elongation and contraction of the main body of the developing apparatus.

16 Claims, 17 Drawing Sheets

DEVELOPING APPARATUS AND CLEANING APPARATUS

BACKGROUND OF THE INVENTION

1. Field of the Invention

The present invention relates to a developing apparatus and a cleaning apparatus suitable for use in an image forming apparatus such as a printer, a copying machine, a facsimile or the like.

2. Description of the Related Art

One example of a conventional process cartridge detachable from an image forming apparatus will hereinafter be described with reference to FIGS. 13 to 16. In FIG. 13 and FIG. 14, numeral 101 refers to a developing roller as a developing agent carrier, and a developing blade 102 as a developing agent layer thickness regulating member, disposed in parallel with a longitudinal direction of the developing roller 101, is disposed in direct contact with a surface of the developing roller 101. Both ends of the developing blade 102 are secured by screws to seat surfaces 104*a* of a developing container 104.

As shown in FIG. 14, a pressingly contacting force between the developing blade 102 and the developing roller 101 is controlled by a flexure angle $\theta_1$ of an elastic portion 102*a*.

In FIG. 16, numeral 105 is a photosensitive drum, and a cleaning blade 106 as a cleaning member, disposed in parallel with a longitudinal direction of the photosensitive drum 105, is disposed in direct contact with a surface of the photosensitive drum 105. Similarly, the cleaning blade 106 is secured by screws 103 to seat surfaces 107*a* of a cleaning frame 107.

As shown in FIG. 16, a pressingly contacting force between the cleaning blade 106 and the photosensitive drum 105 is controlled by a spacing distance (intrusion amount) Q between a virtual position of a tip of an elastic portion 106*a* of the cleaning blade 106 without the photosensitive drum 105 and a directly contacting point Y of the elastic portion 106*a* with the photosensitive drum 105, and also by a flexure angle $\theta_2$ of the elastic portion 106*a*.

In the aforementioned conventional example, however, internal temperature of the image forming apparatus changes due to influences such as installation environment or fixing device temperature, and accompanied by this change, temperatures of respective parts inside the process cartridge change, too. When the temperature inside the apparatus rises, the developing container 104 and the developing blade 102 are elongated in right and left directions in FIG. 15 (in an arrow a direction) according to respective coefficients of thermal expansion.

At this time, as for the developing container 104 made of resin and a sheet metal portion 102*b*, made of metal, of the developing blade 102, the developing container 104 made of resin has a larger coefficient of liner thermal expansion (a typical resin has a coefficient of liner thermal expansion of $7\times10^{-5}$; iron has a coefficient of liner thermal expansion $1.12\times10^{-5}$) and a larger elongation than those of the sheet metal portion 102*b*, thereby deforming the sheet metal portion in a downward direction in FIG. 15 (in an arrow b direction) based on screws 103 as base points provided in two spots, and therefore, the flexure angle $\theta_1$ at a center portion in a longitudinal direction of the developing blade 102 shown in FIG. 14 becomes smaller, with the result that a pressingly contacting force of the developing blade 102 with respect to the developing roller 101 becomes lower at the center portion in the longitudinal direction.

When a pressingly contacting force of the developing blade 102 becomes lower at the center portion of the longitudinal direction, a thickness of a toner coat and a frictionally sliding charging amount on the developing roller 101 become reduced, and therefore an image density at the center portion in the longitudinal direction becomes lowered, which might cause image unevenness.

For example, it has experimentally proved that, provided that a length of the securing portions (a spacing distance between holes for the screws 103 of the end portions) of the sheet metal portion 102*b* of the developing blade 102 is 211 mm and the temperature is changed to 30° C., a changing amount in a downward direction (in a arrow b direction) was approximately 0.4 mm at the center portion in the longitudinal direction of the developing blade 102.

When temperature is lowered, on the other hand, the deforming direction becomes in an upward direction in FIG. 15 (in an arrow c direction) which is an opposite direction when the temperature becomes higher, and therefore, a pressingly contacting force of the developing blade 102 becomes increased at the center portion in the longitudinal direction. Due to this, the thickness of the toner coat and the sliding-rubbing charging amount on the developing roller 101 become increased, and then an image density at the center portion in the longitudinal direction becomes higher, which might cause image unevenness.

Also, when the temperature inside the image forming apparatus rises, the cleaning frame 107 and the cleaning blade 106 shown in FIG. 16 becomes elongated in the right and left directions in FIG. 15 (in an arrow a direction) according to respective coefficients of thermal expansion, in the same way as that of the aforementioned developing container 104 and the developing blade 102 shown in FIG. 15.

At this time, as for the cleaning frame 107 made of resin and a sheet metal portion 106*b*, made of metal, of the cleaning blade 106, the cleaning frame 107 made of resin has a larger coefficient of liner thermal expansion and a larger elongation than those of the sheet metal portion 106*b*, thereby deforming the sheet metal portion in a downward direction in FIG. 15 (in an arrow b direction) based on the screws 103 as base points provided in the two spots, and therefore, the flexure angle $\theta_2$ at a center portion in a longitudinal direction of the cleaning blade 106 shown in FIG. 16 becomes smaller, with the result that a pressingly contacting force of the cleaning blade 106 with respect to the photosensitive drum 105 becomes decreased at the center portion in the longitudinal direction and the intrusion amount Q with respect to the photosensitive drum 105 also becomes decreased, thus to cause problems such as a cleaning insufficiency or the like.

When temperature is lowered, on the other hand, the deforming direction becomes in an upward direction in FIG. 15 (in an arrow c direction) which is an opposite direction when the temperature becomes higher, and therefore, a pressingly contacting force of the cleaning blade 106 becomes increased at the center portion in the longitudinal direction, and the intrusion amount Q with respect to the photosensitive drum 105 becomes in excess. Thus, when an inappropriate portion of the elastic portion 106*a* of the cleaning blade 106, instead of the tip of the elastic portion 106*a* which is originally designed to be contacted with a surface of the photosensitive drum 105, is contacted with the surface of the photosensitive drum 105, cleaning insufficiency occurs; for example, residual developing agent, which is supposed to be scraped off, on the surface of the photosensitive drum 105 goes by to remain thereon. In addition, the photosensitive drum has been rubbed for a long time, which then causes problems such as a shorter lifetime of the photosensitive drum 105.

SUMMARY OF THE INVENTION

An object of the present invention is to provide a developing apparatus which absorbs a difference between elongation and contraction of a regulating member and elongation and contraction of a main body of the developing apparatus.

An another object of the present invention is to provide a cleaning apparatus which absorbs a difference between elongation and contraction of a cleaning member and elongation and contraction of a main body of the cleaning apparatus.

A still another object of the present invention is to provide a developing apparatus in which a positional relation between the regulating member and a developing agent carrier is not changed, irrespective of temperature changes.

A still another object of the present invention is to provide a developing apparatus in which a positional relation between the cleaning member and a body subjected to a cleaning process is not changed, irrespective of temperature changes.

Still further object and characteristics will be clear by reading the detail description of the invention described below with reference to accompanying drawings.

BRIEF DESCRIPTION OF THE DRAWINGS

The above and other objects and features of the invention are apparent to those skilled in the art from the following referred embodiments thereof when considered in conjunction with the accompanied drawings, in which.

DETAILED DESCRIPTION OF THE PREFERRED EMBODIMENTS

Figure 1:
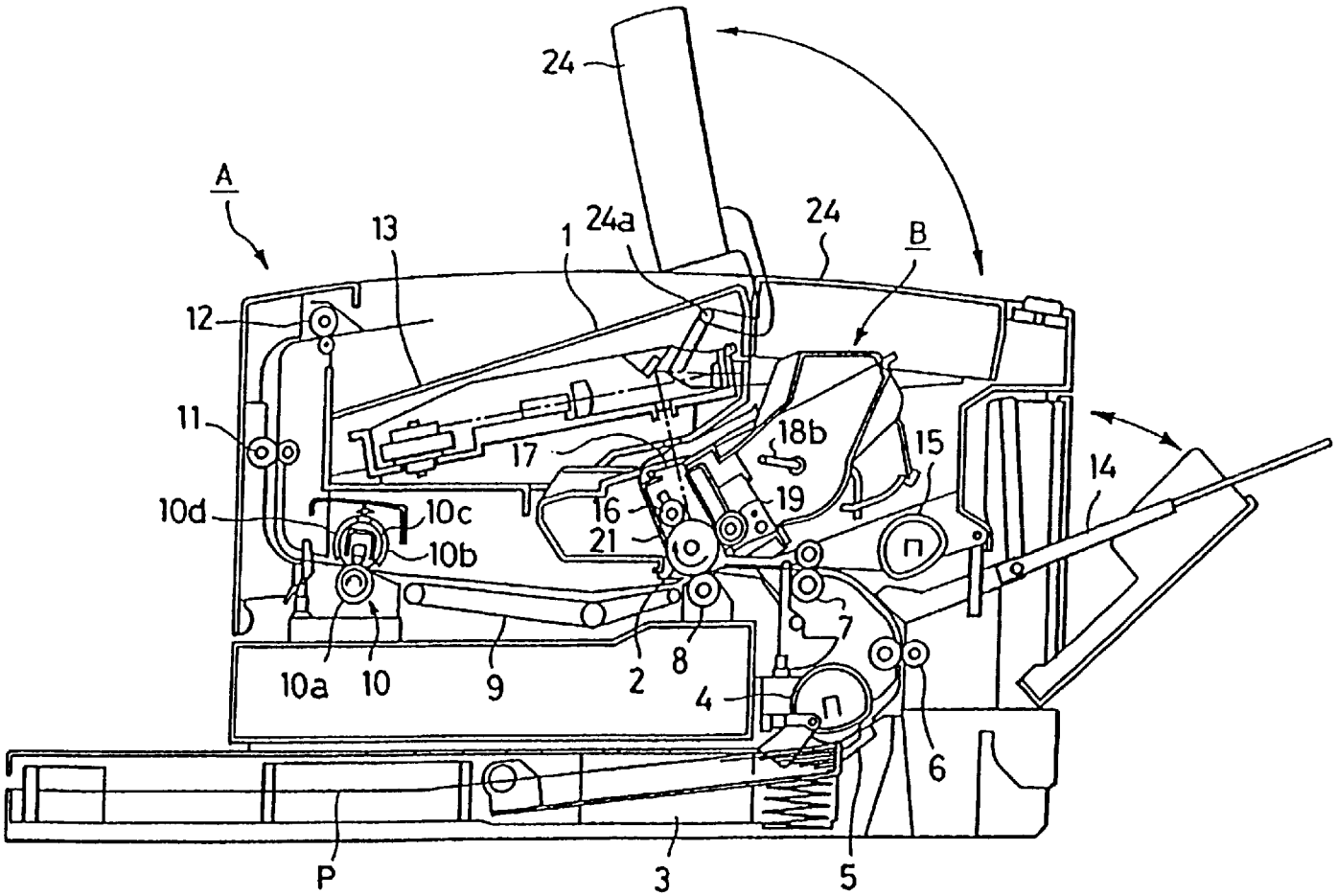
FIG. 1 is a cross-sectional explanation view showing a structure of an image forming apparatus to which a process cartridge provided with a developing apparatus and a cleaning apparatus according to the present invention is detachably mounted.
Figure 2:
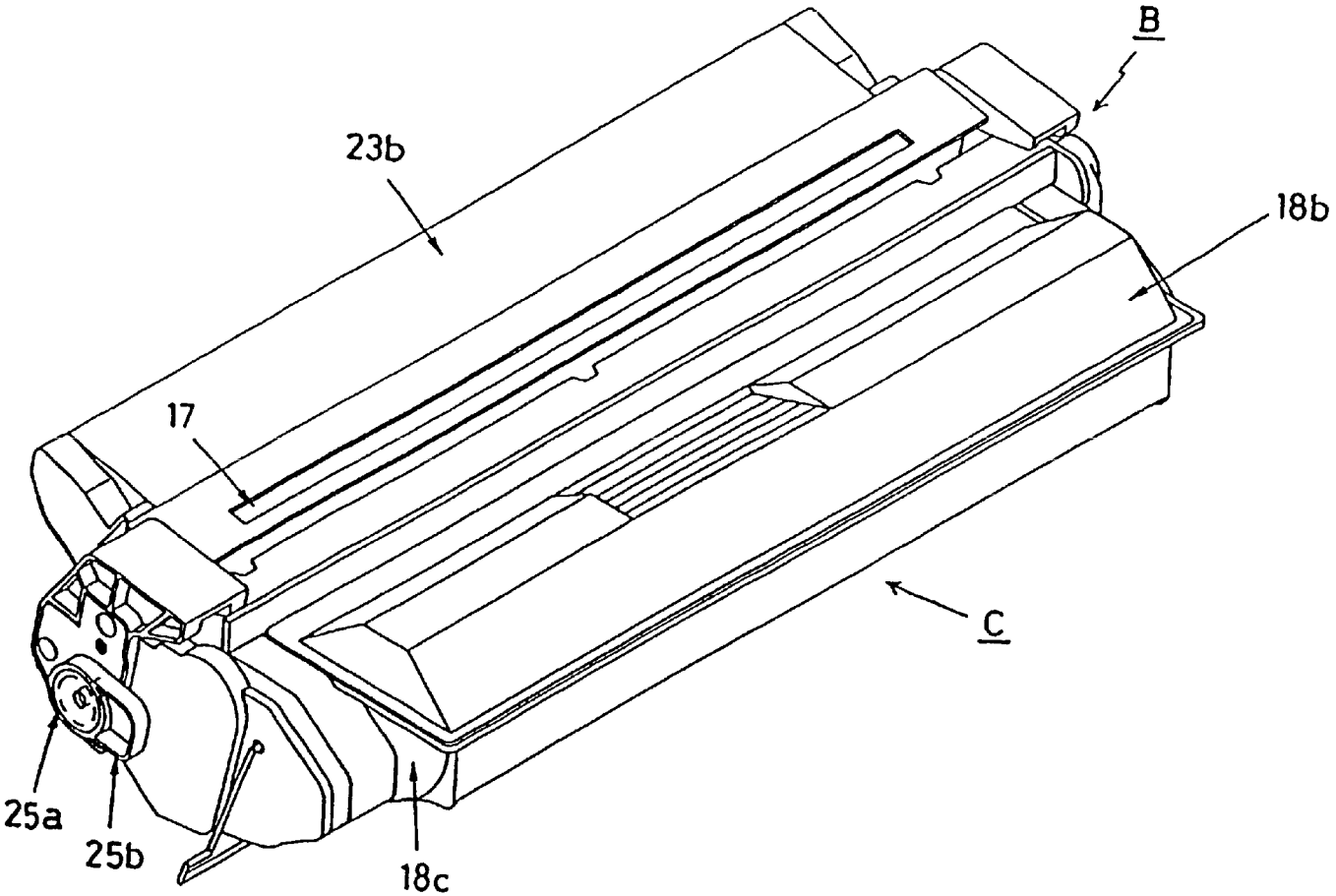
FIG. 2 is a perspective view of an exterior appearance from a right side showing a structure of the process cartridge.
Figure 3:
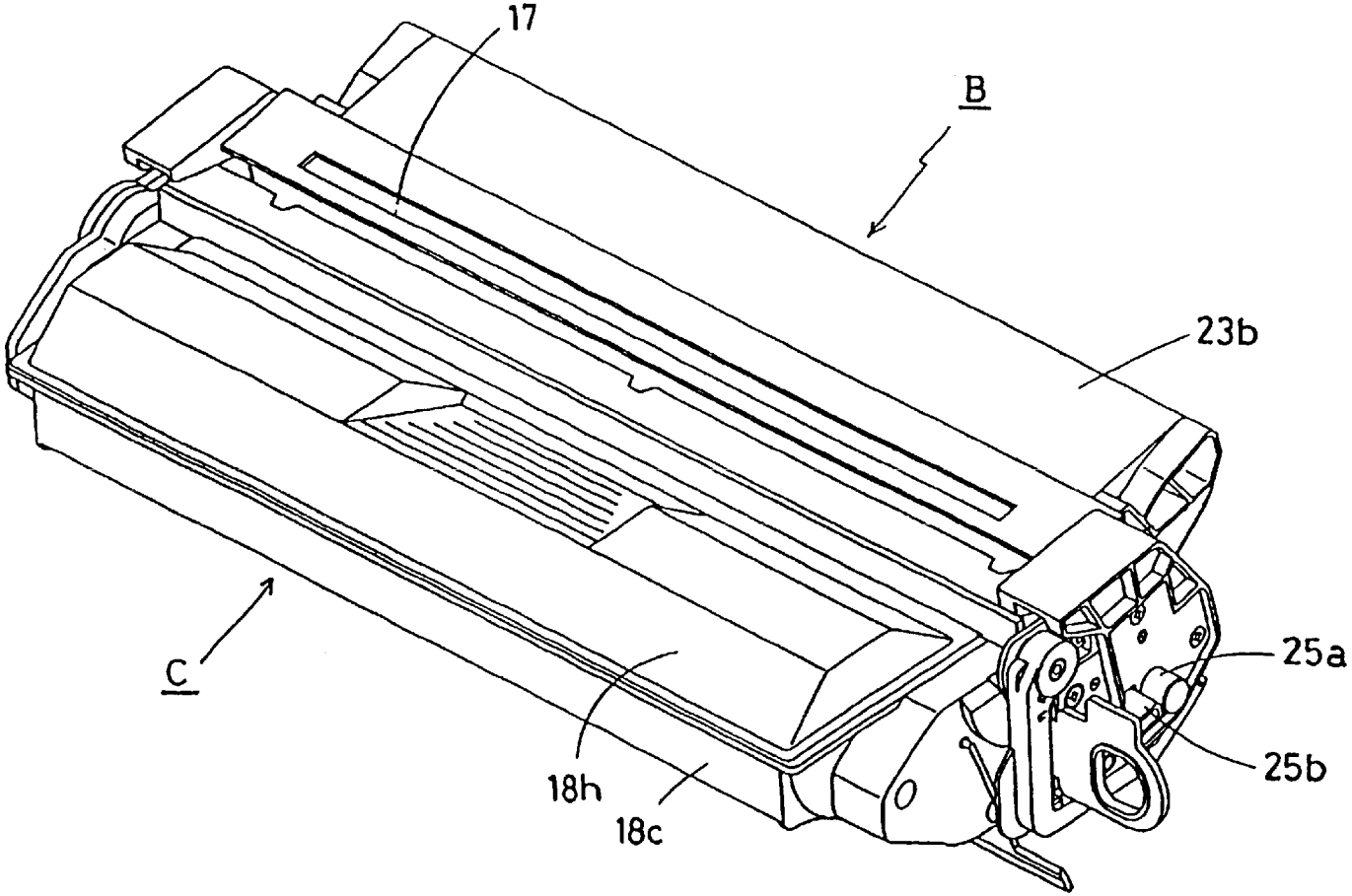
FIG. 3 is a perspective view of the exterior appearance from a left side showing the structure of the process cartridge.
Figure 4:
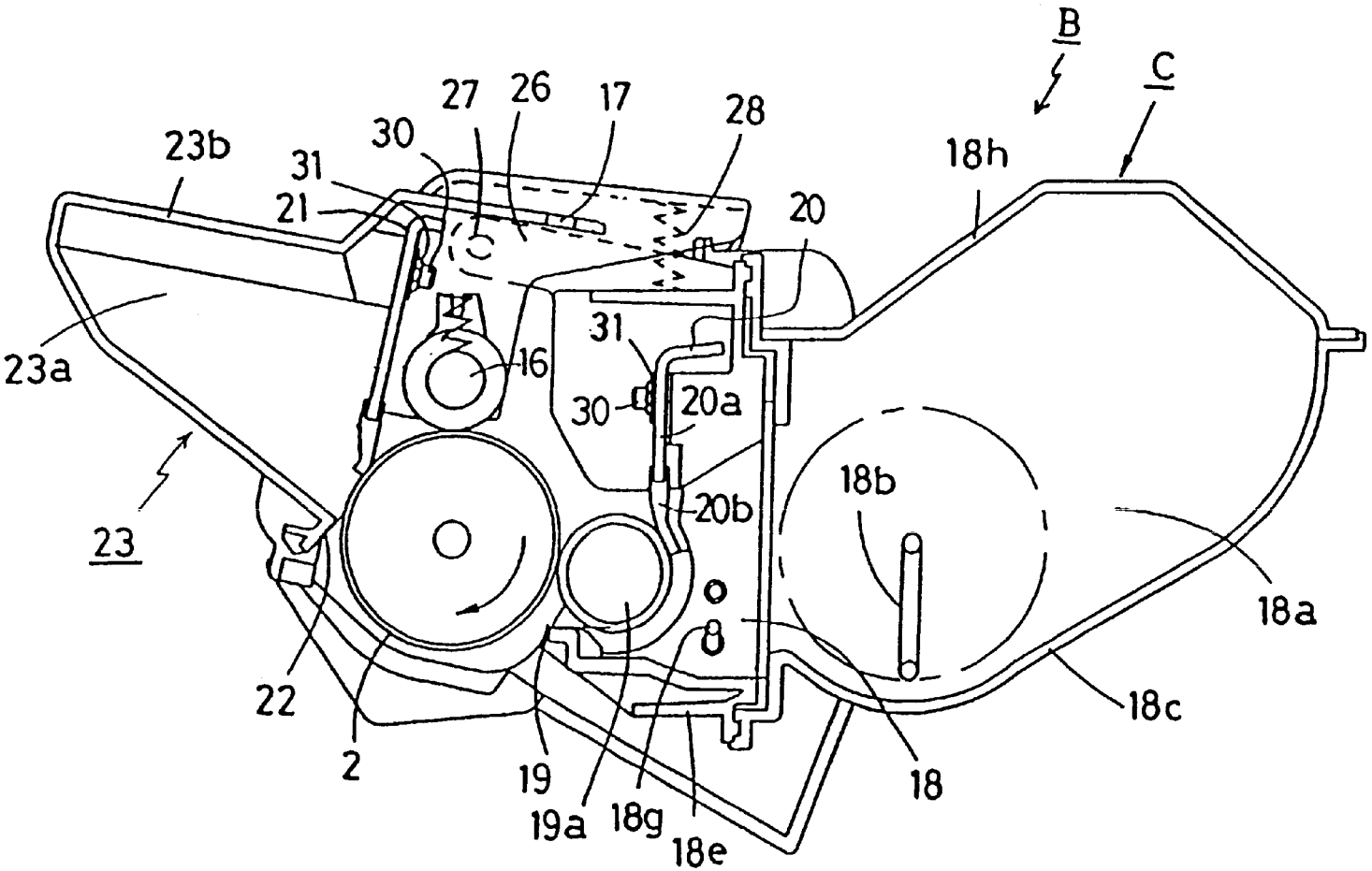
FIG. 4 is a transverse-sectional explanation view showing the structure of the process cartridge.
Figure 5:
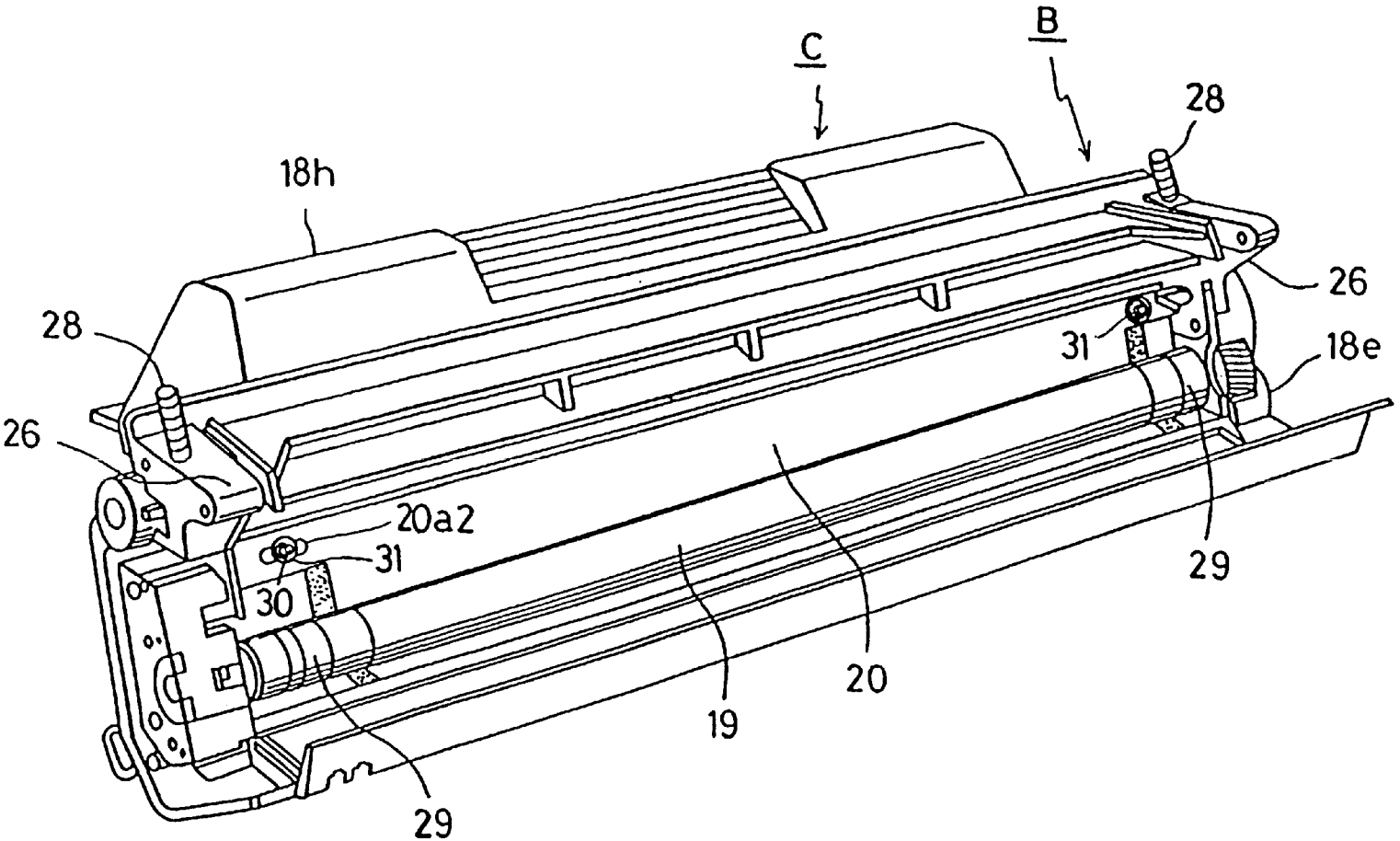
FIG. 5 is a perspective view showing a structure of a first embodiment of the developing apparatus according to the present invention.
Figure 6:
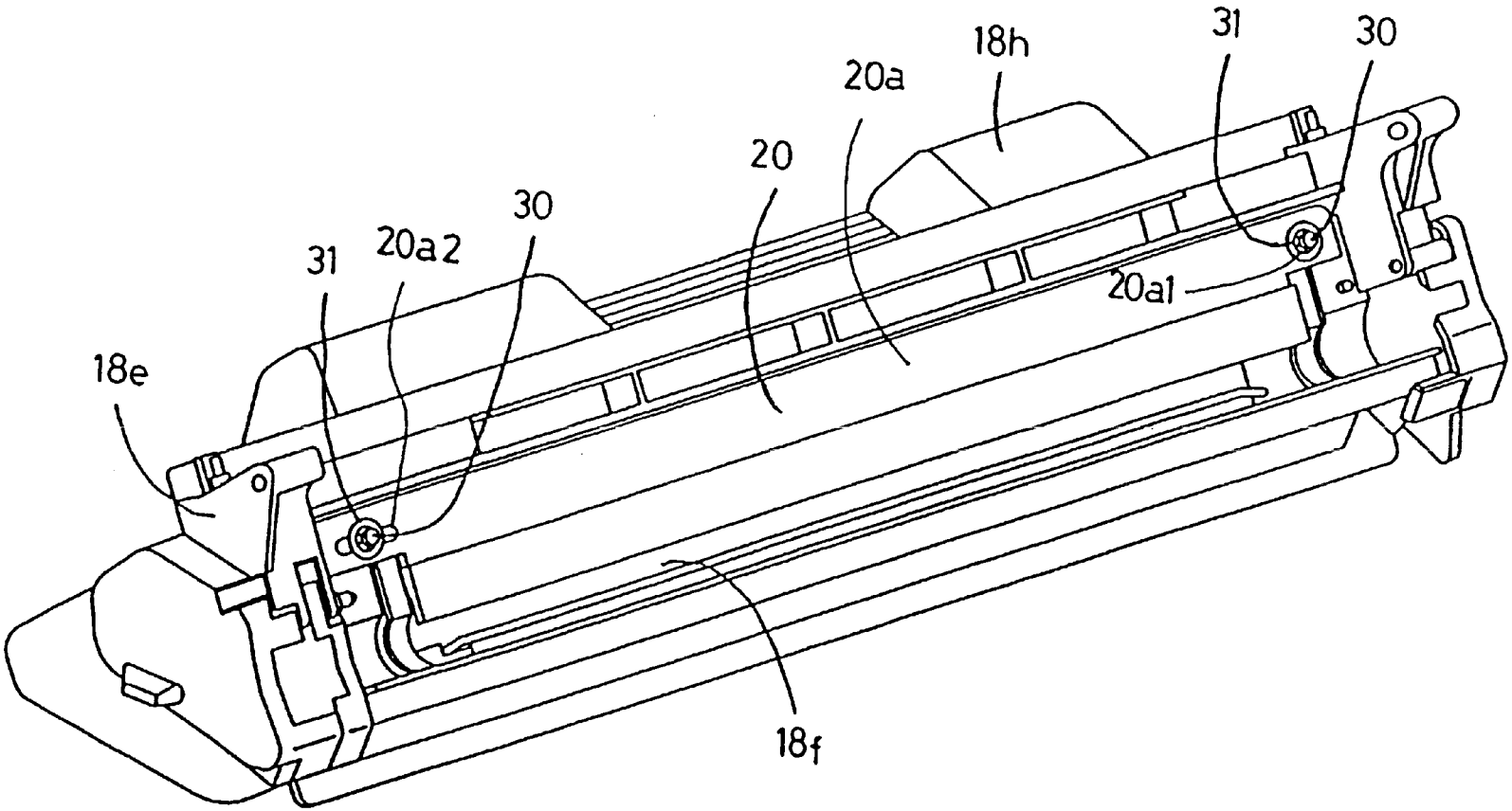
FIG. 6 is a perspective explanation view showing a state where a developing agent carrier has been detached from the first embodiment of the developing apparatus according to the present invention.
Figure 7:
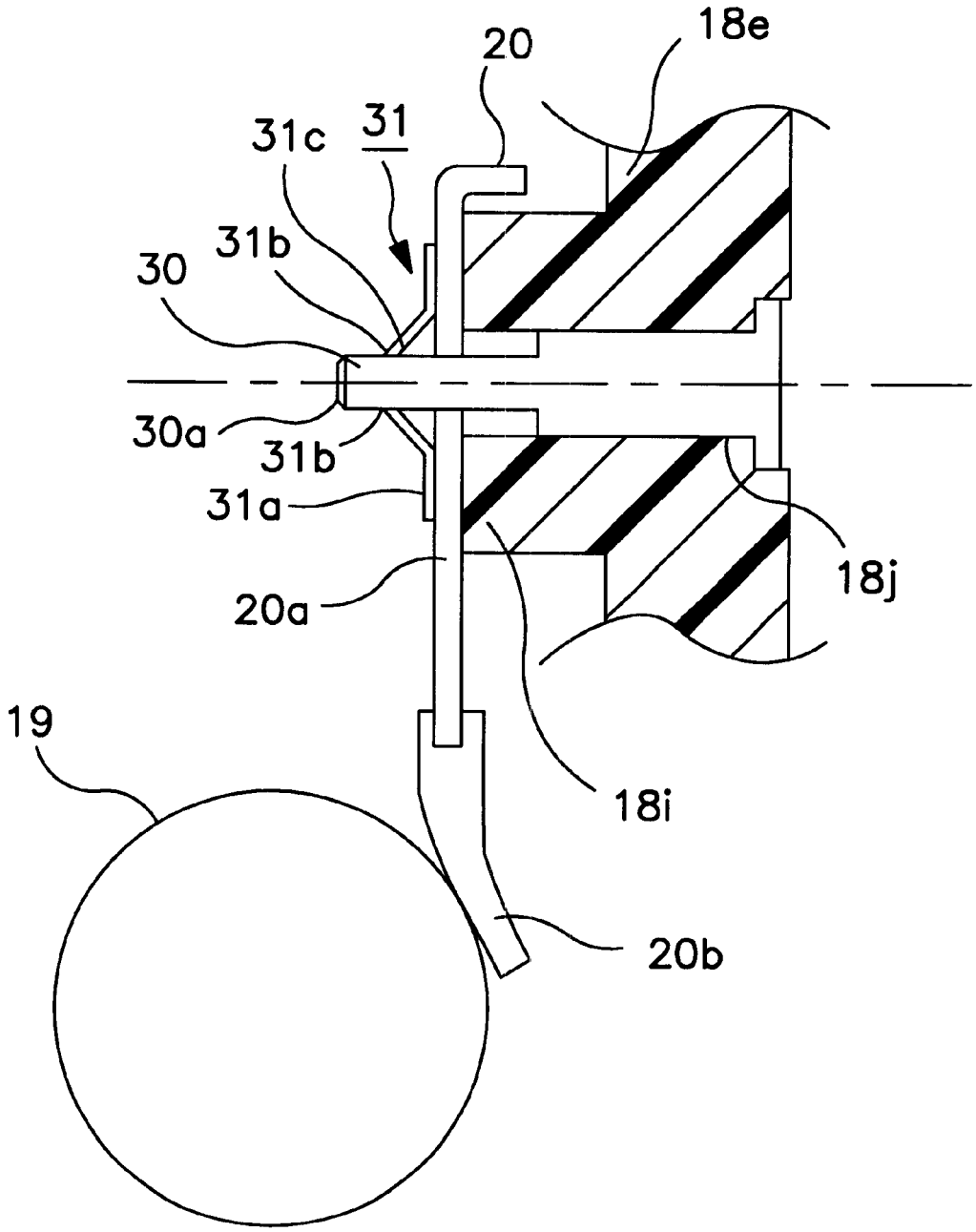
FIG. 7 is a cross-sectional explanation view showing a structure of a securing means of a layer thickness regulating member.
Figure 8:
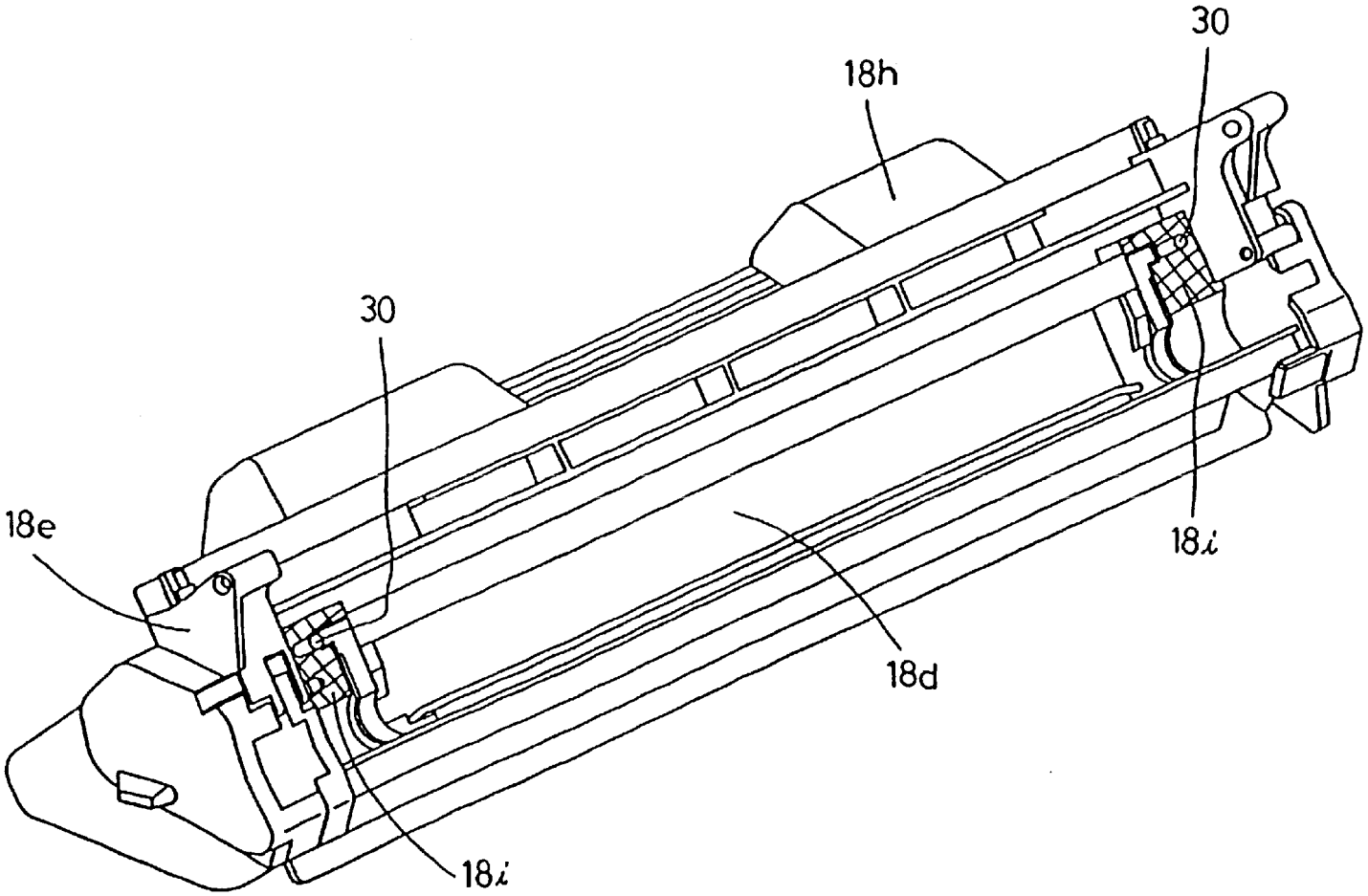
FIG. 8 is a perspective explanation view showing a structure of a securing axis to be inserted into a hole provided at the layer thickness regulating member.
Figure 9:
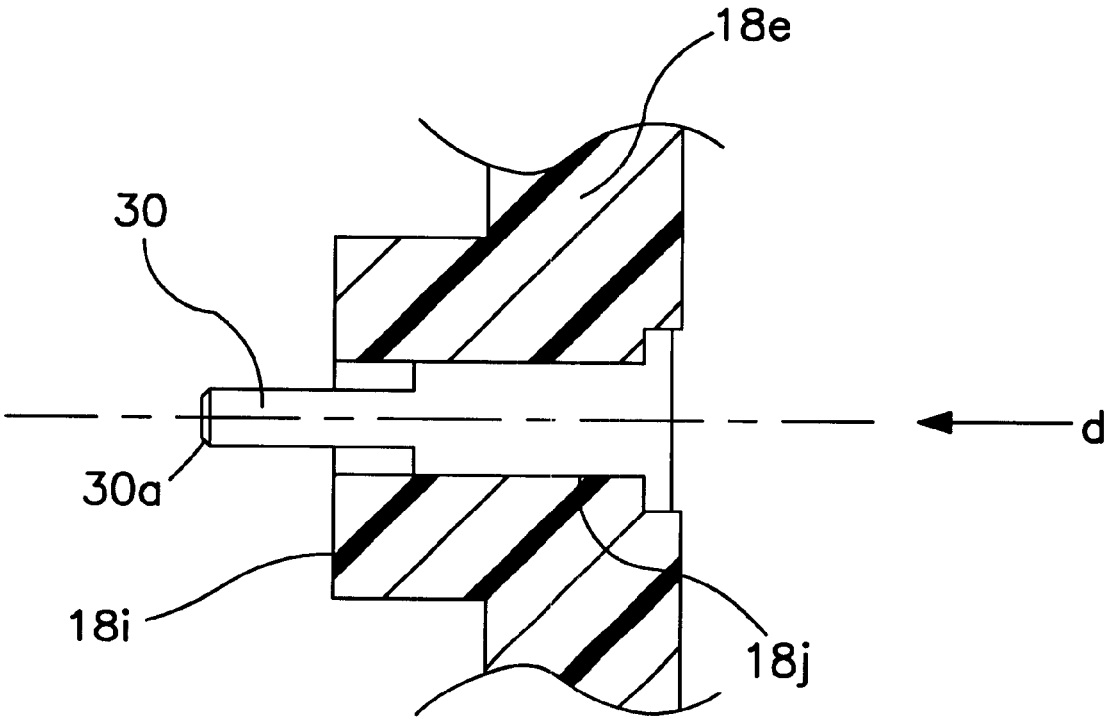
FIG. 9 is a cross-sectional explanation view showing the structure of the securing axis to be inserted into the hole provided at the layer thickness regulating member.

Referring to the drawings, one embodiment, in which an example of an image forming apparatus provided with a process cartridge in a detachably manner including a developing apparatus and a cleaning apparatus according to the present invention, or the like is applied to a laser beam printer, will be specifically described. FIG. 1 is a cross-sectional explanation view showing a structure of an image forming apparatus to which a process cartridge provided with a developing apparatus and a cleaning apparatus according to the present invention is detachably mounted; FIG. 2 is a perspective view of an exterior appearance from a right side showing a structure of the process cartridge; FIG. 3 is a perspective view of the exterior appearance from a left side showing the structure of the process cartridge; FIG. 4 is a transverse-sectional explanation view showing the structure of the process cartridge; FIG. 5 is a perspective view showing a structure of a first embodiment of the developing apparatus according to the present invention; FIG. 6 is a perspective explanation view showing a state where a developing agent carrier has been detached from the first embodiment of the developing apparatus according to the present invention; FIG. 7 is a cross-sectional explanation view showing a structure of a securing means of a layer thickness regulating member; FIG. 8 is a perspective explanation view showing a structure of a securing axis to be inserted into a hole provided at the layer thickness regulating member; and FIG. 9 is a cross-sectional explanation view showing the structure of the securing axis to be inserted into the hole provided at the layer thickness regulating member.

[Entire Structure]

First, referring to FIG. 1, an entire structure of a laser beam printer as an image forming apparatus mounting detachably a process cartridge including a developing apparatus and a cleaning apparatus according to the present invention will be explained. As shown in FIG. 1, in a laser beam printer A as an electrophotographic image forming apparatus, an electrophotographic photosensitive drum 2 as a image carrier with its surface uniformly charged is irradiated with a laser beam based on image information from an optical system 1 to form an electrostatic latent image, and then developing agent (hereinafter referred to as "toner") is supplied to the electrostatic latent image to form a toner image.

Synchronously with the formation of the toner image on the photosensitive drum 2, recording mediums P constituted of paper, synthetic resin or the like contained in a feeding cassette 3 are separately fed sheet by sheet by means of a pick-up roller 4 and a contacting member 5 for pressingly contacting therewith, and then conveyed by conveying means consisting of a pair of conveying rollers 6, a pair of register rollers 7 and the like. Then, the toner image formed on the photosensitive drum 2 which is contained in a cartridge as a process cartridge B is applied with voltage to a transfer roller 8 as a transfer means, thus to be transferred on the recording medium P. Thereafter, the recording medium P is conveyed by a conveying belt 9 to a fixing apparatus 10.

The fixing apparatus 10 includes a driving roller 10*a* and a heater 10*b* internally and also has a fixing rotator 10*d* constituted of a cylindrical sheet supported rotatably on a support 10*c,* where the recording medium P passing through a nip portion between the driving roller 10*a* and the fixing rotator 10*d* is heated and then subjected to pressurizing treatment, so the transferred toner image is eternally fixed.

The recording medium P is conveyed by a pair of delivering rollers 11, 12, through a reverse conveying path to be delivered onto a delivery section 13. Incidentally, this laser beam printer A has a structure capable of conducting a manual feeding with a manual tray 14 and a feeding roller 15.

[Structure of Process Cartridge]

The process cartridge B is provided with the photosensitive drum 2 and at least one of image forming process means. Here, the image forming process means include, for example, a charging means for charging the surface of the photosensitive drum 2, a developing means for developing the electrostatic latent image formed on the photosensitive drum 2, a cleaning means for cleaning residual toner remaining on the surface of the photosensitive drum 2, or the like.

In the process cartridge B of the present embodiment, as shown in FIG. 4, the photosensitive drum 2 as an electrophotographic photosensitive member having a photosensitive layer is rotated and voltage is applied to a charging roller 16 as a charging means to charge uniformly the surface of the photosensitive drum 2. Then, the charged photosensitive drum 2 is exposed to light image from the optical system 1 through an exposure opening 17 to form an electrostatic latent image, and thereafter the toner as a developing agent is supplied from the developing apparatus 18 as a developing means to the electrostatic latent image, thereby achieving developing process.

In the developing apparatus 18, toner is conveyed by a rotatable toner conveying member 18*b* as a developing agent conveying means placed inside a toner container 18*a* as a developing agent container for containing the developing agent, through an opening 18*d* (See, e.g., FIG. 8) of a toner frame 18*c* molding the toner container 18*c* into a developing agent container and an opening 18*f* (See, e.g., FIG. 6) of a developing frame 18*e,* to be conveyed into the developing frame 18*e*. Then, the toner is agitated by a toner agitating member 18*g,* and a developing roller 19 as a developing agent carrier having a built-in stationary magnet 19*a* is rotated, and on the surface of the developing roller 19, there is formed a toner layer provided with frictional electrification charges by a developing blade 20 as a layer thickness regulating member for regulating the layer thickness of toner attached on the surface of the developing roller 19. The toner thus formed is transferred onto the surface of the photosensitive drum 2 where the electrostatic latent image has been formed, thus forming a toner image for visualization.

Then, after a voltage having a polarity opposite to the toner image is applied to the transfer roller 8 to transfer the toner image onto the recording medium P, the residual toner remaining on the surface of the photosensitive drum 2 is removed by a cleaning apparatus 23 where a cleaning blade 21 as a cleaning member scrapes off the residual toner on the photosensitive drum 2, and a dip sheet 22 dips the toner to collect into a waste toner container 23*a* as a collected developing agent container.

Connecting a developing unit C integrally formed by welding together the toner frame 18*c* which constitutes the toner container 18*a* and supports the toner conveying member 18*b* so as to be rotary driven; the developing frame 18*e* having built-in developing means such as the toner agitating member 18*g,* the developing roller 19, the developing blade 20 or the like; and a covering member 18*h,* with the cleaning frame 23*b* constituting the waste toner container 23*a* and having the photosensitive drum 2, the cleaning blade 21, the dip sheet 22 and the charging roller 16 then constitutes a cartridge frame in which the respective members such as photosensitive drum 2 or the like are contained, thereby making the frame usable as a cartridge which is detachably mounted with respect to a cartridge mounting means provided in the main body of the image forming apparatus.

As for the cartridge means, when an opening and closing member 24 is opened at an axis 24*a* as a center shown in FIG. 1, a space of the cartridge mounting section appears, and in the right and left sides, there are arranged cartridge mounting guide members (not shown). Guides consisting of bosses 25*a* and ribs 25*b* shown in FIG. 2 and FIG. 3 of a process cartridge B are introduced so as to be fitted to the mounting guides (not shown), and the process cartridge B is detached from the main body of the image forming apparatus.

It is to be noted that, as shown in FIG. 4 and FIG. 5, an arm portion 26 is protruding over the developing frame 18*e* toward the cleaning frame 23*b*. The tip of this arm portion 26 is connected with the cleaning frame 23*b* by a pin 27 as shown in FIG. 4 so that both can rotate freely with respect to each other. Then, a compressing coil spring 28 is pressingly provided between the arm portion 26 extending to the developing unit C of the cleaning frame 23*b* and the developing frame 18*e,* thereby making the developing roller 19 pressingly contacted with the photosensitive drum 2.

As shown in FIG. 5, both the ends outside the image forming region of the developing roller 19 are provided with spacer rollers 29 having respectively a larger diameter than that of the developing roller 19, and the spacer rollers 29 are pressingly contacted with the photosensitive drum 2, thereby obtaining a gap of approximately 300 $\mu$m, in the developing region, between the photosensitive drum 2 and the developing roller 19.

As materials for forming the toner frame 18*c* and the developing frame 18*e,* plastics are employed including, for example, polystyrene, ABS resin (acrylonitrile/butadiene/styrene copolymer), denatured PPE resin (polyphenylene ether), denatured PPO resin (polyphenylene oxide), polycarbonate, polyethylene, polypropylene or the like.

As shown in FIG. 8 and FIG. 9, in the present embodiment, two metal axes 30 are standingly disposed in a protruding manner at the both ends in a longitudinal direction of seat surfaces 18*i,* to which the developing blade 20 is secured, of the developing frame 18 as the main body of the developing apparatus.

The metal axis 30 may be provided, for example, by insert molding at the same time when the molding of the developing frame 18*e* is carried out; or as shown in FIG. 9, it may be secured by being pressingly fitted into a hole 18*j* having a stepped portion for attaching the metal axis 30 thereto, the hole 18*j* being formed from a side opposite to the seat surface 18*i* for attaching the developing blade 20 thereto, to the developing frame 18 (an arrow d direction in FIG. 9).

On the other hand, the developing blade 20 is provided with an elastic blade and a sheet metal portion 20*a* as a supporting member for supporting the elastic blade, and the sheet metal portion 20*a* of the developing blade 20 is punched with a circular hole 20*a*1 having a diameter corresponding to the outer diameter of the metal axis 30 and a longer hole 20*a*2 having a major axis which is larger than the outer diameter of the metal axis 30, where those holes are designed to be fitted with the metal axis 30 provided in a standing manner which protrudes beyond the seat surface 18*i* of the developing frame 18*e*. As for the longer hole 20*a*2, a diameter in a direction perpendicular to the longitudinal direction of the developing blade corresponds to the outer diameter of the metal axis 30, but a diameter in the longitudinal direction of the developing blade is larger than that of the metal axis 30, with the result that the developing blade is designed to be allowed to move substantially only in the longitudinal direction.

When the developing blade 20 is secured to the seat surface 18*i* of the developing frame 18*e*, the metal axis 30 projecting from the seat surface 18*i* is fitted into the hole 20*a*1 and the longer hole 20*a*2 formed on the sheet metal portion 20*a* of the developing blade 20 to make the sheet metal portion 20*a* of the developing blade 20 directly contacted with the seat surface 18*i*, and then a push nut 31 as a securing means is fittingly mounted on the metal axis 30 to be engagingly stopped thereto, thereby securing the developing blade 20 to the seat surface 18*i* of the developing frame 18*e*.

Figure 17:
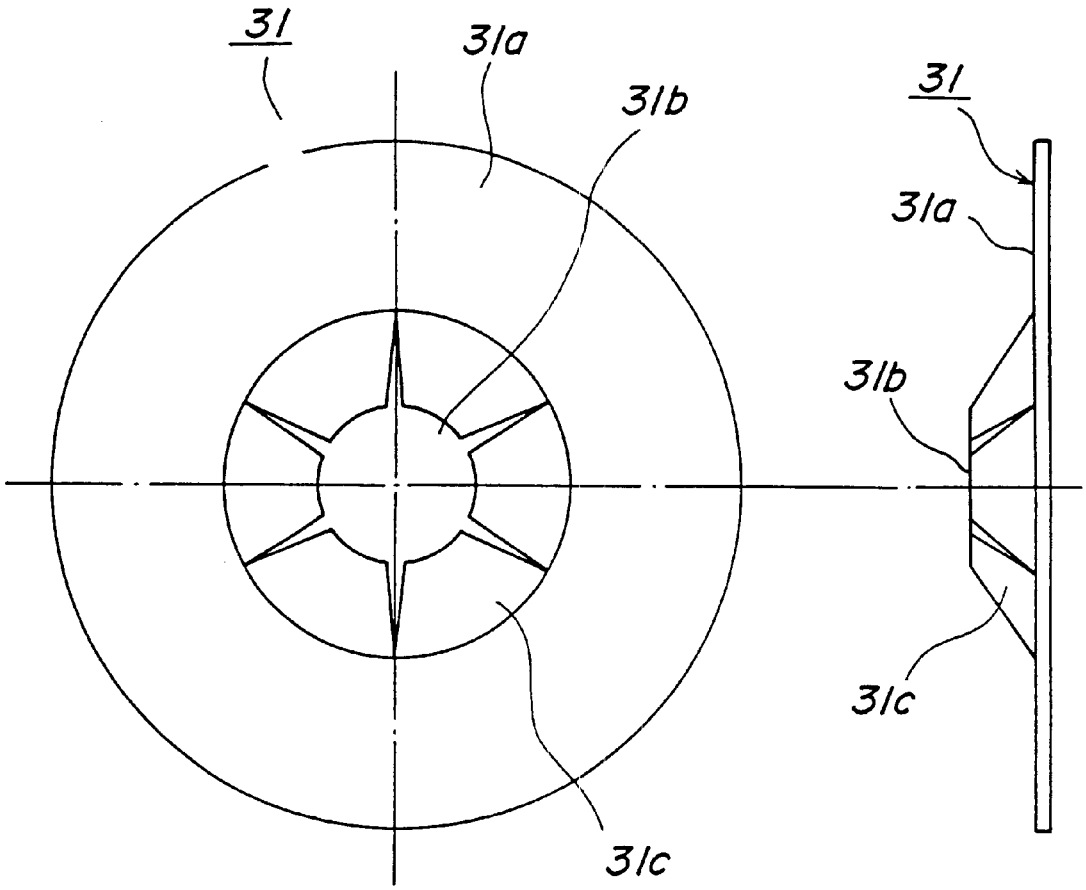
FIG. 17 is a front view and a side view of a securing member(a push nut) of a thickness-of-layer regulating member.

As shown in FIG. 7 and FIG. 17, the push nut 31 is constituted of: a flat base plate portion 31*a* (a base body portion) formed at an outer edge portion (outer peripheral portion); a penetrating hole 31*b*, formed at approximately the center portion of the push nut 31, into which the metal axis 30 is inserted; a plurality of cutting portions formed with a predetermined interval respectively, from the side of the penetrating hole 31*b* to the direction of the diameter of the penetrating hole 31*b* at a part from the base plate portion 31*a* toward the penetrating hole 31*b*; and a plurality of sloping pieces 31*c* formed by bending a part nipped by the cutting portions into respectively one surface side.

As for the push nut 31, the sloping piece 31*c* as a nail portion for engaging with the metal axis 30 to be engagingly stopped has an elasticity, so the fastening force is slightly weaker than that of the aforementioned screws 103 in the conventional example, and also the sheet metal portion 20*a* of the developing blade 20 is pushed onto the seat surface 18*i* of the developing frame 18*e* with a predetermined force to be secured thereto, and therefore the elastic portion 20*b* of the developing blade 20 is directly contacted with the surface of the developing roller 19 with a predetermined force.

Since one of the holes formed on the sheet metal portion 20*a* of the developing blade 20 for being attached to the metal axis 30 is the longer hole 20*a*2 and the push nut 31 has the cutting portions, when the developing frame 18*e* is deformed due to temperature changes, a sliding is produced in the longitudinal direction between the sheet metal portion 20*a* of the developing blade 20, and the developing frame 18*e* as well as the push nut 31, thereby suppressing the deformation of the developing blade 20 like the aforementioned conventional example. As a result, a pressingly contacting force of the developing blade 20 can be maintained constantly.

As a material for the metal axis 30 protruding beyond the seat surface 18*i* of the developing frame 18*e*, it is preferred to have a hardness which enables the sloping piece 31*c* as a nail portion of the push nut 31 to be bitten into the metal axis 30 at the time of attaching the push nut 31, thus to bring about the fastening force; for example, such a material as having a hardness HV=around 300 to 400 of Vickers hardness, more specifically, stainless steel or the like is desirable, but it is not limited to this as long as foreign substances such as generated cut powders or the like are removed by carrying out air vacuuming or the like at the time of attaching the push nut 31.

In addition, in order to carry out easily and certainly the operation of attaching the push nut 31, a tip portion of the metal axis 30 preferably forms a beveled portion 30*a*.

With the above structure where the metal axis 30 disposed on the seat surface 18*i* of the developing frame 18*e* is fitted into the hole 20*a*1 and the longer hole 20*a*2 formed in the sheet metal portion 20*a* of the developing blade 20, which is then engagingly stopped by the push nut 31 to be secured thereto, a major axis range of the longer hole 20*a*2 can absorb a difference in elongation and contraction due to the difference in coefficients of thermal expansion between the developing frame 18*e* and the sheet metal portion 20*a* of the developing blade 20, resulting in that, without producing a difference in flexure angles between the end portions and the center portion in the longitudinal direction of the developing blade 20, and also without producing a difference in pressingly contacting forces with respect to the developing roller 19, occurrence of image defectiveness becomes preventable.

Figure 10:
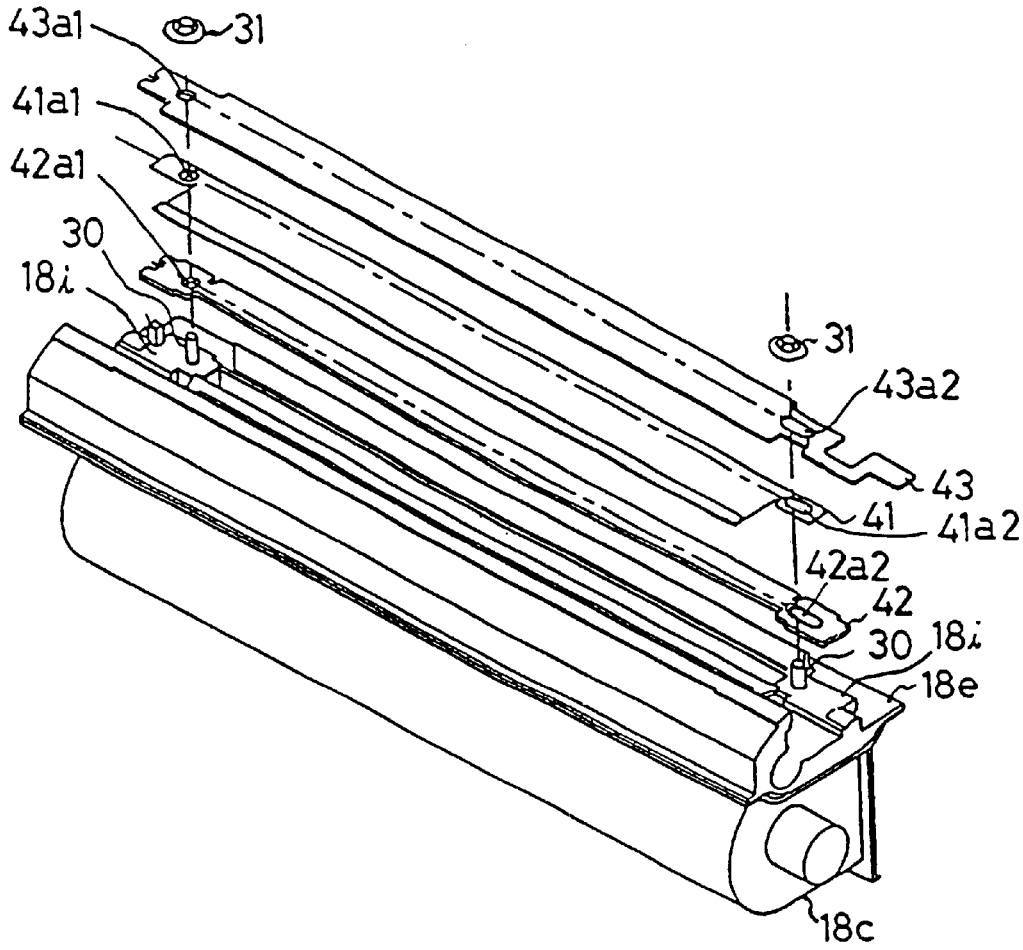
FIG. 10 is an assembling explanation view showing a structure of a second embodiment of the developing apparatus according to the present invention.

Next, referring to FIG. 10, a second embodiment of the developing apparatus according to the present invention will be described. FIG. 10 is an assembling explanation view showing a structure of the second embodiment of the developing apparatus according to the present invention. It is to be noted that descriptions for the members structured in the same way as those of the aforementioned first embodiment will be omitted by providing the identical numerals.

In the aforementioned first embodiment, one example where the developing blade 20 as a layer thickness regulating member is integrally formed of the sheet metal portion 20*a* and the elastic portion 20*b* was described, but in the second embodiment, as shown in FIG. 10, an elastic blade 41 made of elastic material is sandwiched between two pieces of supporting plates 42, 43 made of metal, to be secured onto the seat surface 18*i* of the developing frame 18*e*.

The elastic blade 41 and the supporting plates 42, 43 are punched with holes 41*a*1, 42*a*1, and 43*a*1 having respectively a diameter corresponding to the outer diameter of the metal axis 30 and longer holes 41*a*2, 42*a*2, and 43*a*2 having respectively a major diameter which is larger than the outer diameter of the metal axis 30, where those holes are designed to be fitted with the metal axis 30 provided in a standing manner which is protruding beyond the seat surface 18*i* of the developing frame 18*e*. After sequentially fitting the metal axis 30 into, first, the hole 42*a*1 and the longer hole 42*a*2 in the supporting plate 42, next the hole 41*a*1 and the longer hole 41*a*2 in the elastic blade 41, and further the hole 43*a*1 and the longer hole 43*a*2 in the supporting plate 43, the elastic blade 41 in a state of being sandwiched between the supporting plates 42, 43 is then directly contacted with the seat surface 18*i* of the developing frame 18*e*, and then the metal axis 30 is secured by fittingly mounting the push nut 31 thereon.

In the present embodiment, a major axis range of the respective longer holes 41*a*2, 42*a*2 and 43*a*2 can also absorb a difference in elongation and contraction due to the difference in coefficients of thermal expansion between the elastic blade 41 and the supporting plates 42, 43, resulting in that, without producing a difference in flexure angles between the end portions and the center portion in the longitudinal direction of the elastic blade 41, and also without producing a difference in pressingly contacting forces with respect to the developing roller 19, occurrence of image defectiveness becomes preventable. Other configurations are formed in the same way as that of the first embodiment, and the same advantages can be obtained.

Figure 11:
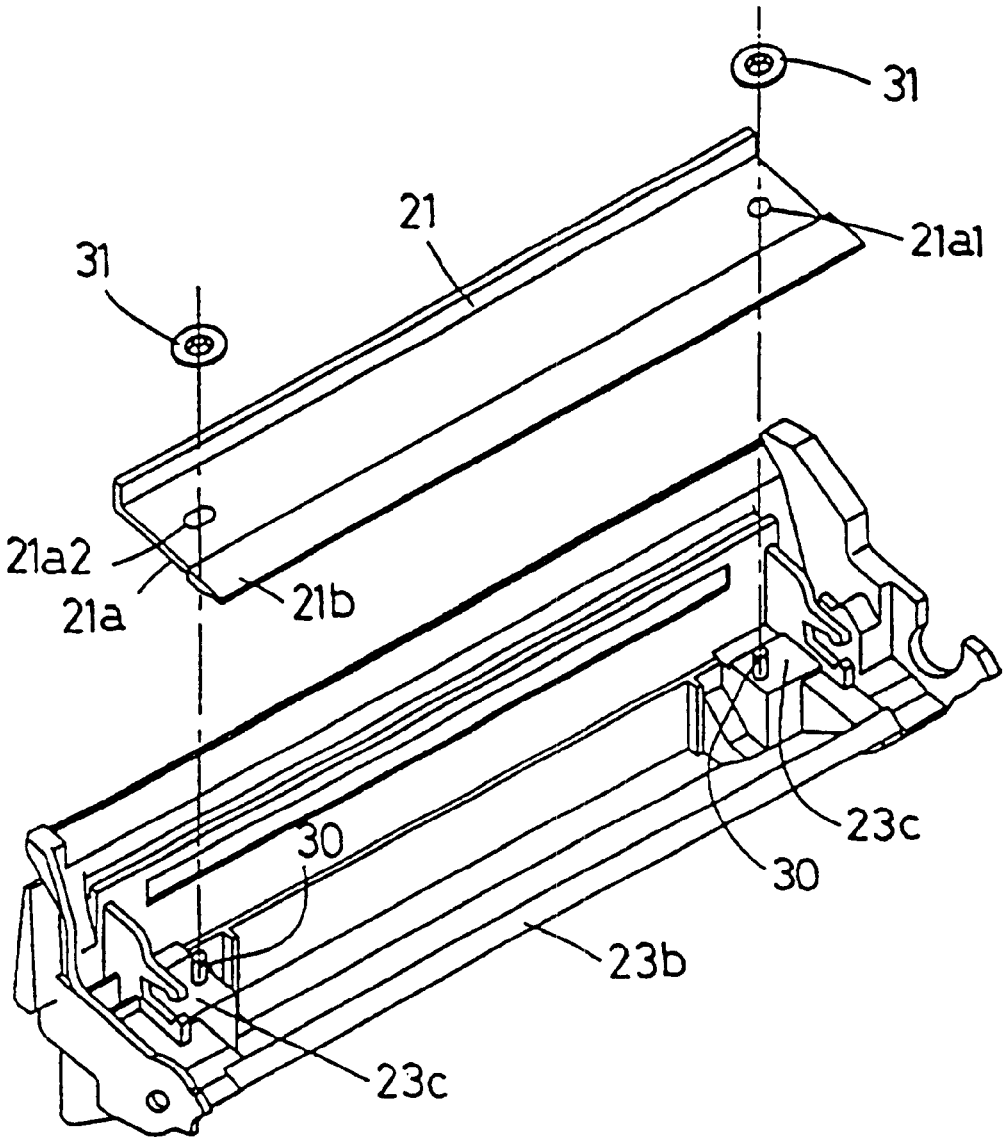
FIG. 11 is an assembling explanation view showing a structure of the cleaning apparatus according to the present invention.
Figure 12:
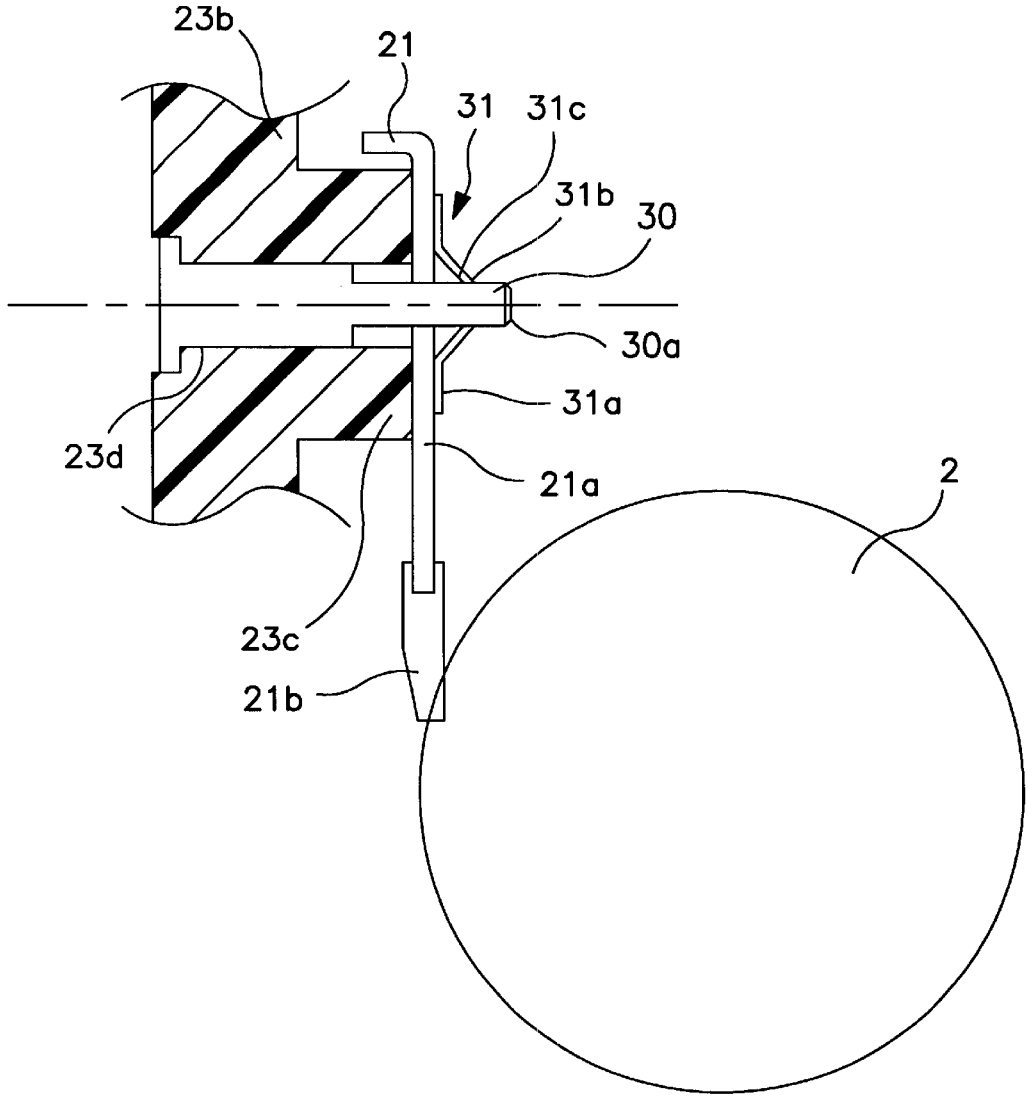
FIG. 12 is a cross-sectional explanation view showing a structure of a securing means of the cleaning member.
Figure 13:
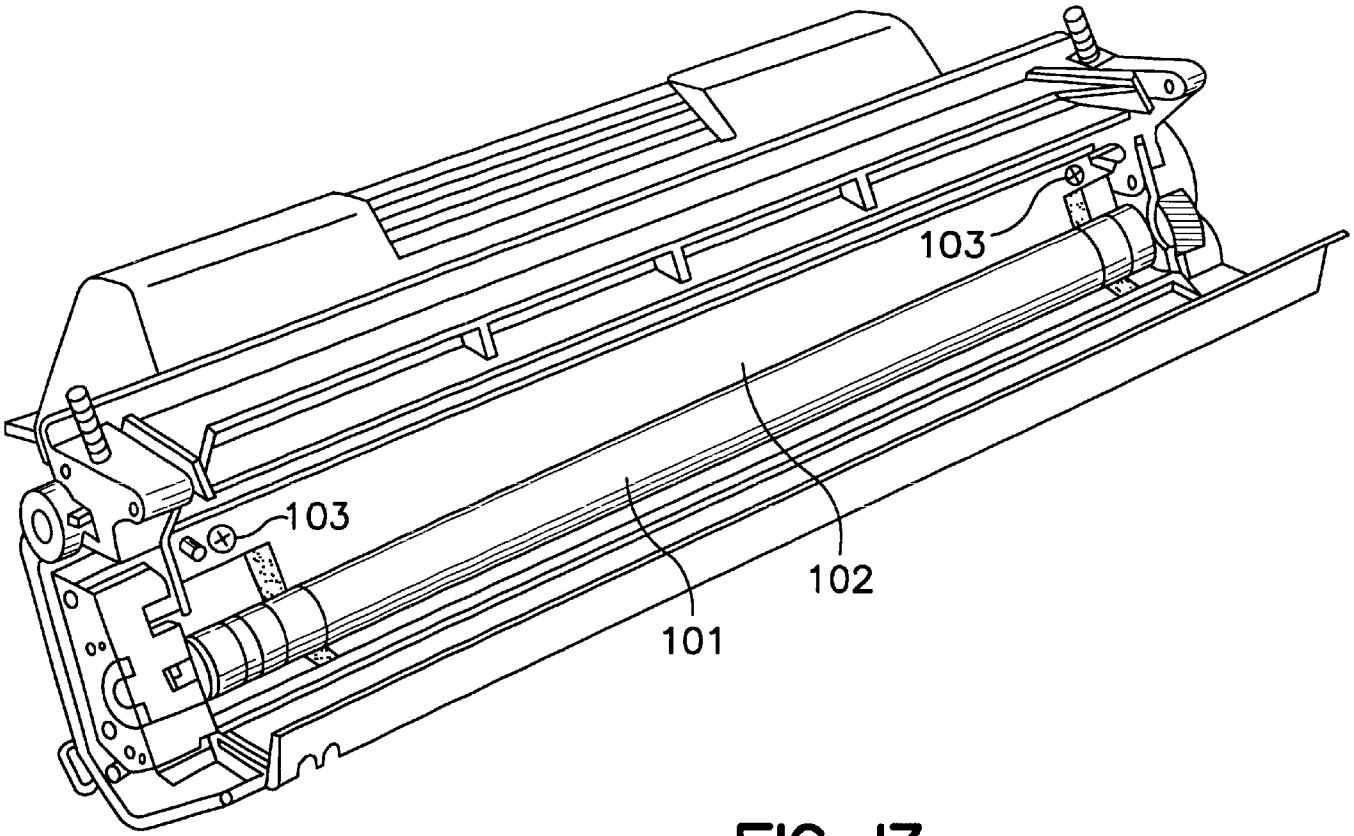
FIG. 13 PRIOR ART
FIG. 13 is a view showing a structure of a securing means of a developing blade according to a conventional developing apparatus.
Figure 14:
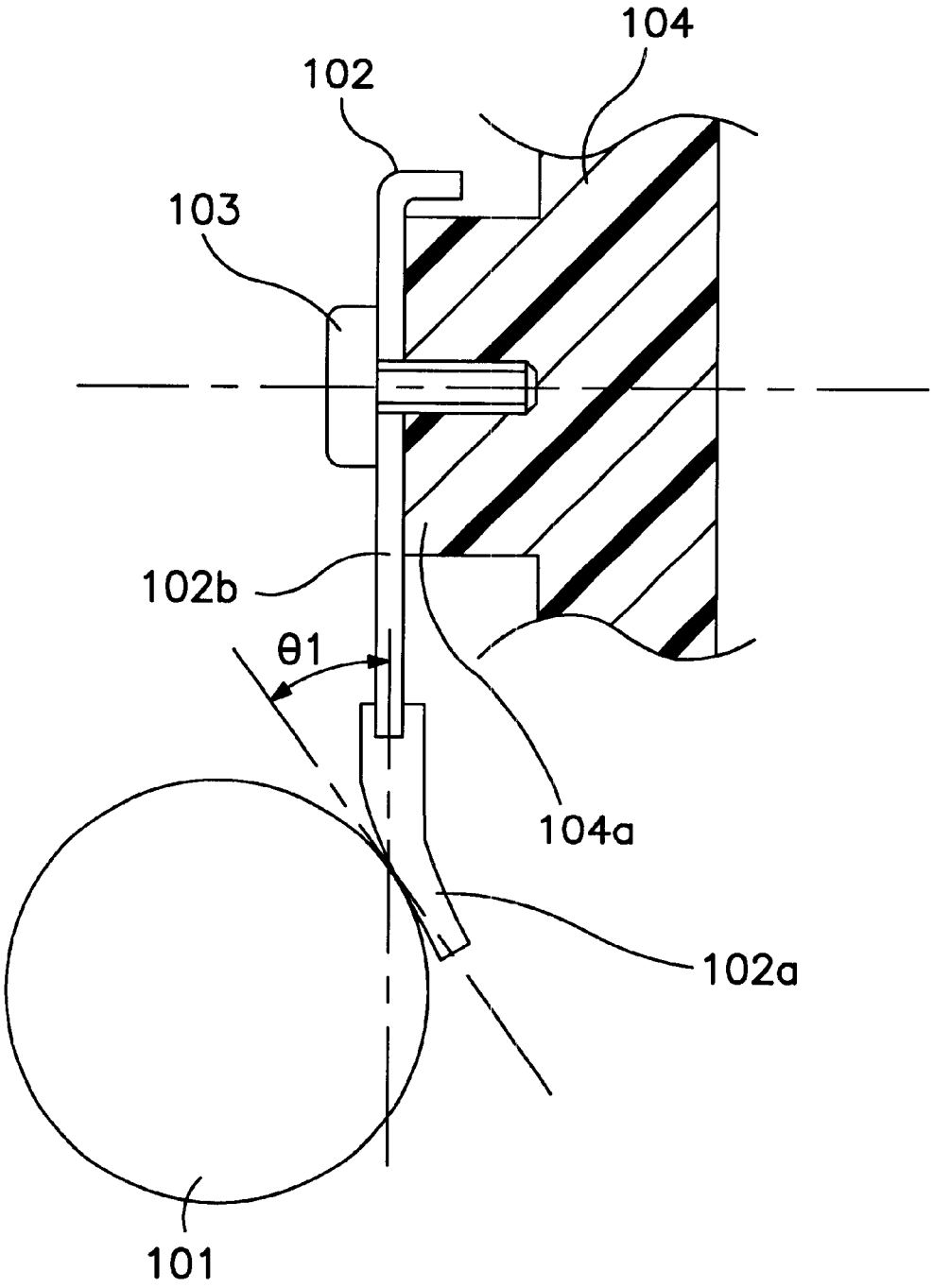
FIG. 14 PRIOR ART
FIG. 14 is a view showing the structure of the securing means of the developing blade according to the conventional developing apparatus.
Figure 15:
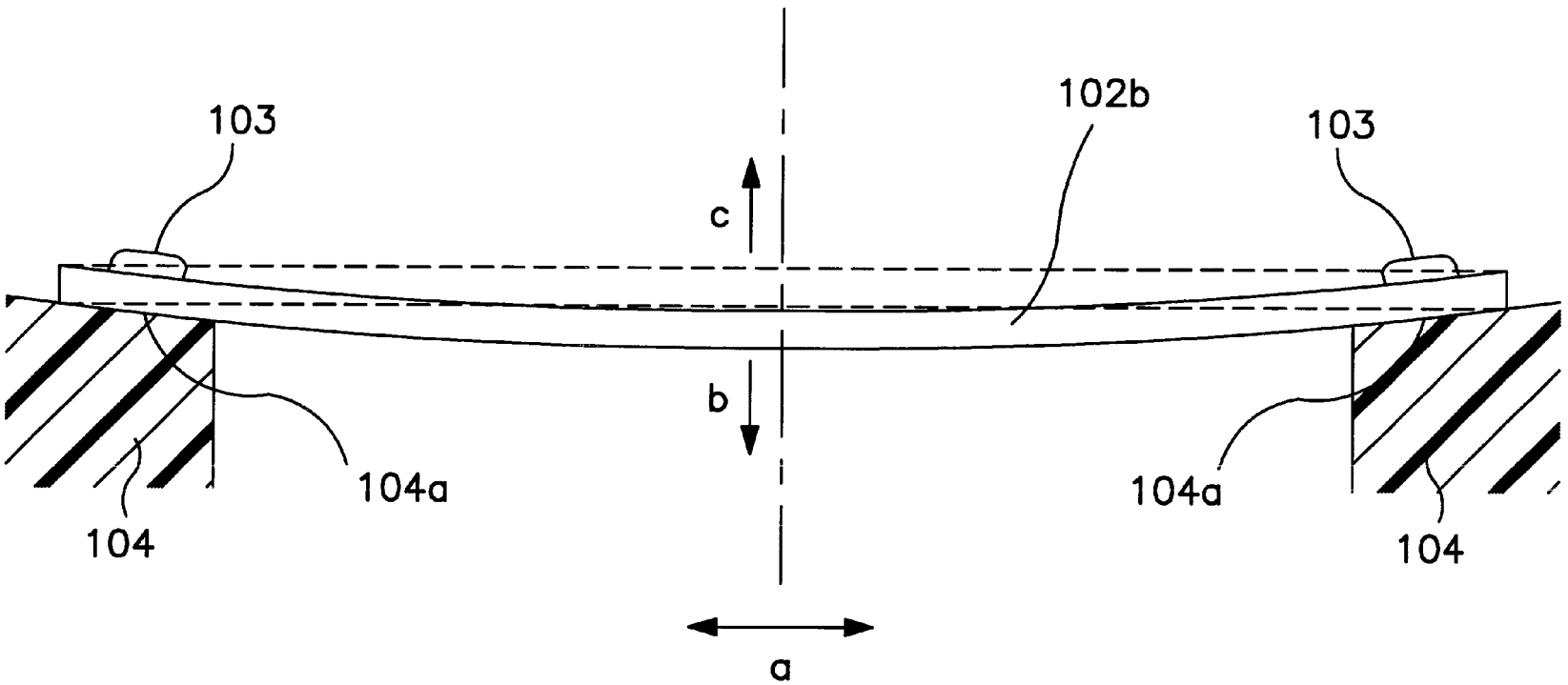
FIG. 15 PRIOR ART
FIG. 15 is a view explaining a problem of the securing means of the conventional developing apparatus.

Next, a structure of a cleaning apparatus according to the present invention will be described with reference to FIG. 4, FIG. 11 and FIG. 12. FIG. 11 is an assembling explanation view showing a structure of the cleaning apparatus according to the present invention and FIG. 12 is a cross-sectional explanation view showing a structure of a securing means of the cleaning member. It is to be noted that descriptions for the members structured in the same way as those of the respective embodiments will be omitted by providing the identical numerals.

As shown in FIG. 11 and FIG. 12, in the present embodiment, two metal axes 30 are standingly disposed in a protruding manner at the both ends in a longitudinal direction of seat surfaces 23*c*, to which a cleaning blade 21 as a cleaning member is secured, of a cleaning frame 23*b* as a main body of the developing apparatus.

Similar to the aforementioned embodiment, the metal axis 30 may be provided, for example, by insert molding at the same time when the molding of the cleaning frame 23*b* is carried out; or as shown in FIG. 12, it may be secured by being pressingly fitted into a hole 23*d* having a stepped portion for attaching the metal axis 30 thereto, the hole 23*d* being formed from a side opposite to the seat surface 23*c* for attaching the cleaning blade 21 thereto, to the cleaning frame 23*b* (from a left side direction in FIG. 12).

On the other hand, the sheet metal portion 21*a* of the cleaning blade 21 is punched with a hole 21*a*1 having a diameter corresponding to the outer diameter of the metal axis 30 and a longer hole 21*a*2 having a major axis which is larger than the outer diameter of the metal axis 30, where those holes are designed to be fitted with the metal axis 30 provided in a standing manner which protrudes beyond the seat surface 23*c* of the cleaning frame 23*b*.

When the cleaning 21 is secured to the seat surface 23*c* of the cleaning frame 23*b*, the metal axis 30 projecting from the seat surface 23*c* is fitted into the hole 21*a*1 and the longer hole 21*a*2 formed in the sheet metal portion 21*a* of the cleaning blade 21 to make the sheet metal portion 21*a* of the cleaning blade 21 directly contacted with the seat surface 23*c*, and then the aforementioned push nut 31 as a securing means is fittingly mounted on the metal axis 30 to be engagingly stopped thereto, thereby securing the cleaning blade 21 to the seat surface 23*c* of the cleaning frame 23*b*.

As for the push nut 31, the sloping piece 31*c* as a nail portion for engaging with the metal axis 30 to be engagingly stopped has an elasticity, so the fastening force is slightly weaker than that of the aforementioned screw 103 in the conventional example, and also the cleaning blade 21 is pushed onto the seat surface 23*c* of the cleaning frame 23*b* with a predetermined force to be secured thereto, and therefore an elastic portion 21*b* of the cleaning blade 21 is directly contacted with the surface of the photosensitive drum 2 with a predetermined force.

Figure 16:
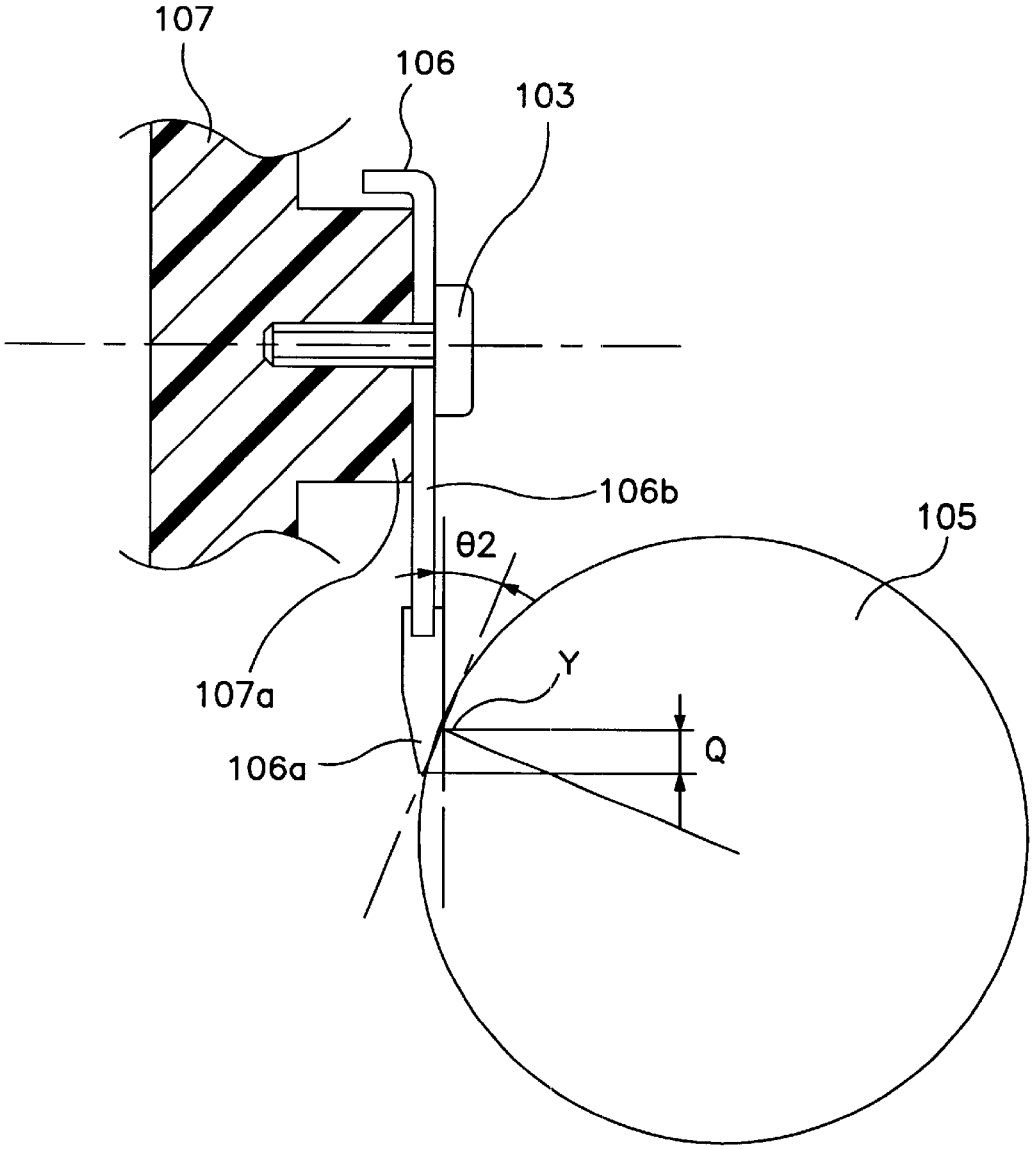
FIG. 16 PRIOR ART
FIG. 16 is a view showing a structure of a securing means of a cleaning blade according to a conventional cleaning apparatus.

Since one of the holes formed on the sheet metal portion 21*a* of the cleaning blade 21 for being attached to the metal axis 30 is the longer hole 21*a*2, when the cleaning frame 23*b* is deformed due to temperature changes, a sliding is produced in the longitudinal direction between the sheet metal portion 21*a* of the cleaning blade 21, and the cleaning frame 23*b* as well as the push nut 31, thereby suppressing the deformation of the cleaning blade 21 like the aforementioned conventional example. As a result, a pressingly contacting force and an intrusion amount Q (See, FIG. 16) of the cleaning blade 21 can be maintained constantly.

With the above structure where the metal axis 30 disposed in a standing manner on the seat surface 21*a* of the cleaning frame 23*b* is fitted into the hole 21*a*1 and the longer hole 21*a*2 formed in the sheet metal portion 21*a* of the cleaning blade 21, which is then engagingly stopped by the push nut 31, a major axis range of the longer hole 21*a*2 can absorb a difference in elongation and contraction due to the difference in coefficients of thermal expansion between the cleaning frame 23*b* made of resin and the sheet metal portion 21*a* made of metal of the cleaning blade 21, resulting in that, without producing: a difference in flexure angles between the end portions and the center portion in the longitudinal direction of the cleaning blade 21; a difference in pressingly contacting forces with respect to the photosensitive drum 2; and a difference in intrusion amounts with respect to the photosensitive drum 2, occurrence of cleaning insufficiency becomes preventable and a lifetime of the photosensitive drum 2 can be improved as well.

It is to be noted that the present invention can be applied not only to a process cartridge such as e process cartridge C of the aforementioned respective embodiment for forming a monochromatic image, but also to such a process cartridge that comprises a plurality of the developing means for forming a multicolor image (for example, two-color image, three-color image, or full-color image).

The electrophotographic photosensitive member is not necessarily limited to the photosensitive drum 2, but the following various compositions are applicable. That is, as a photosensitive member, photoconductive material is utilized, and the photoconductive materials include, for example, amorphous silicon, amorphous selenium, zinc oxide, titanium oxide, organic photoconductive material (OPC) or the like.

As a mounted shape of the photosensitive member, for example, a drum shape, a belt shape or the like is used. Generally the drum shape or the belt shape are employed; for example, in the drum type photosensitive member, the photoconductive material is vapor deposited or applied onto a cylinder of an aluminum alloy or the like.

Furthermore, as the charging means constitution, in the first embodiment, the so-called contact charging method is used, but another constitution may be used, which comprises applying a metal shield of aluminum or the like to a three-way periphery of a conventionally used tungsten wire; moving a positive or negative ion generated by applying a high voltage to the tungsten wire to the surface of the photosensitive drum 2; and uniformly charging the surface of the photosensitive drum 2.

It is to be noted that, as the charging means, besides the aforementioned roller type, a blade type using a charging blade, a pad type, a block type, a rod type, a wire type and the like may be used.

Also, the above-described process cartridge is provided with, for example, an electrophotographic photosensitive member and at least one of image forming process means.

In other words, the above-described process cartridge is an integrally formed cartridge including at least one of a charging means, a cleaning means, or a developing means, and an electrophotographic photosensitive member, and this process cartridge is structured so as to be detachable from the main body of the image forming apparatus.

It is to be noted that, in the aforementioned respective embodiments, a laser beam printer was chosen as an example of the image forming apparatus, but the present invention is also applicable to other forms of image forming apparatuses such as an electrophotographic copying machine, facsimile, word processor, or the like.

According to the above-described embodiments, such a process cartridge can be provided, the process cartridge including a developing apparatus which absorbs a difference in elongation and contraction due to a difference in coefficients of thermal expansion between a layer thickness regulating member for regulating a layer thickness of a developing agent attached on a surface of a developing carrier and a main body of the developing apparatus for supporting the layer thickness regulating member, or a cleaning apparatus which absorbs a difference in elongation and contraction due to a difference in coefficients of thermal expansion between a cleaning member for collecting the developing agent remaining on the surface of the image carrier and a main body of the cleaning apparatus for supporting the cleaning member, thus capable of preventing the cleaning insufficiency, or other members.

In other words, because a securing axis mounted on the main body of the developing apparatus is fitted into a hole and longer hole formed in the layer thickness regulating member, which is then engagingly stopped by a fixing means to be secured thereto, a major axis range of the longer hole can absorb a difference in elongation and contraction due to the difference in coefficients of thermal expansion between the main body of the developing apparatus and the layer thickness regulating member, resulting in that, without producing a difference in flexure angles between the end portions and the center portion in the longitudinal direction of the layer thickness regulating member, and also without producing a difference in pressingly contacting forces with respect to the developing agent carrier, occurrence of image defectiveness becomes preventable.

In addition, because a securing axis mounted on the main body of the cleaning apparatus is fitted into a hole and a longer hole formed in the cleaning member, which is then engagingly stopped by a securing means, a major axis range of the longer hole can absorb a difference in elongation and contraction due to the difference in coefficients of thermal expansion between the main body of the cleaning apparatus and the cleaning member, resulting in that, without producing: a difference in flexure angles between the end portions and the center portion in the longitudinal direction of the cleaning member; a difference in pressingly contacting forces with respect to the image carrier; and a difference in intrusion amounts with respect to the image carrier, occurrence of cleaning insufficiency becomes preventable and a lifetime of the image carrier can be improved as well.

What is claimed is:

1. A developing apparatus, comprising:

a developing agent carrier for carrying a developing agent to develop an electrostatic latent image formed on an image carrier with the developing agent;

a regulating member for regulating a thickness of a layer of the developing agent carried by the developing agent carrier; and a securing member, provided with an engaging hole for engaging with a pin, for securing said regulating member to a main body of the developing apparatus, wherein said securing member is provided with at least one cutting portion formed around the engaging hole so as to be able to absorb, in a longitudinal direction of said regulating member, a difference between elongation and contraction of said regulating member and elongation and contraction of the main body of the developing apparatus.

2. The developing apparatus according to claim 1, wherein the main body of the developing apparatus is provided with the pin, wherein said regulating member is provided with a longer hole through which the pin is fitted, the longer hole having a larger diameter in the longitudinal direction, and wherein said securing member is engaged with the pin, which has been fitted through the longer hole.

3. The developing apparatus according to claim 2, wherein the pin is mounted in a manner of protruding beyond a surface which attaches said regulating member to the main body of the developing apparatus.

4. The developing apparatus according to claim 3, wherein the pin is made of a metal.

5. The developing apparatus according to claim 2, wherein said regulating member is provided with an elastic blade and a supporting member for supporting said elastic blade, and wherein said supporting member is secured by said securing member to the main body of the developing apparatus.

6. The developing apparatus according to claim 1, wherein said securing member is provided with a base body portion extending along an outer periphery of said securing member, the engaging hole formed approximately at the center portion, and a sloping portion sloping from the base body portion toward the engaging hole, and wherein a plurality of cutting portions is provided respectively in a manner of extending radially.

7. The developing apparatus according to claim 1, wherein said securing member has an elastic property.

8. The developing apparatus according to claim 1, wherein the developing apparatus, together with the image carrier, is mounted in a process cartridge detachable from an image forming apparatus.

9. A cleaning apparatus comprising:

a cleaning member for cleaning a developing agent from a body subjected to a cleaning process by contacting the body subjected to the cleaning process; and a securing member, provided with an engaging hole for engaging with a pin, for securing said cleaning member to a main body of the cleaning apparatus, wherein said securing member is provided with at least one cutting portion formed around the engaging hole so as to be able to absorb a difference between elongation and contraction of said cleaning member in a longitudinal direction of said cleaning member and elongation and contraction of the main body of the cleaning apparatus.

10. The cleaning apparatus according to claim 9, wherein the main body of the cleaning apparatus is provided with the pin, wherein said cleaning member is provided with a longer hole through which the pin is fitted, the longer hole having a larger diameter in the longitudinal direction, and wherein said securing member is engaged with the axis which has been fitted through the longer hole.

11. The cleaning apparatus according to claim 10, wherein the pin is mounted in a manner of protruding beyond a surface which attaches said cleaning member to the main body of the cleaning apparatus.

12. The cleaning apparatus according to claim 11, wherein the pin is made of a metal.

13. The cleaning apparatus according to claim 9, wherein said securing member is provided with a base body portion extending along an outer periphery of said securing member, the engaging hole formed approximately at the center portion, and a sloping portion sloping from the base body portion toward the engaging hole, and wherein a plurality of cutting portions is provided respectively in a manner of extending radially.

14. The cleaning apparatus according to claim 9, wherein said cleaning member is provided with an elastic blade and a supporting member for supporting the elastic blade, and wherein the supporting member is secured by said securing member to the main body of the cleaning apparatus.

15. The cleaning apparatus according to claim 9, wherein said securing member has an elastic property.

16. The cleaning apparatus according to claim 9, wherein the cleaning apparatus, together with an image carrier, is mounted in a process cartridge detachable from an image forming apparatus.

* * * * *

UNITED STATES PATENT AND TRADEMARK OFFICE

CERTIFICATE OF CORRECTION

PATENT NO. : 6,356,730 B1
DATED : March 12, 2002
INVENTOR(S) : Fumito Nonaka

It is certified that error appears in the above-identified patent and that said Letters Patent is hereby corrected as shown below:

Column 1,
Lines 55, 56 and 57, "liner" should read -- linear --.

Column 2,
Line 8, "has" should read -- has been --;
Line 13, "a arrow b" should read -- an arrow b --; and
Line 38, "liner" should read -- linear --.

Column 3,
Line 12, "An another" should read -- Another --;
Line 26, "object" should read -- objects --;
Line 27, "detail" should read -- detailed --; and
Line 32, "referred" should read -- preferred --.

Column 4,
Line 13, "and" should be deleted;
Line 16, "apparatus." should read -- apparatus; and --;
Line 25, "detachably" should read -- detachable --; and
Line 60, "a" should read -- an --.

Column 5,
Line 52, "container 18c" should read -- container 18a --.

Column 10,
Line 19, "producing:" should read -- producing --; and
Line 28, "e" should read -- a --.

UNITED STATES PATENT AND TRADEMARK OFFICE

CERTIFICATE OF CORRECTION

PATENT NO. : 6,356,730 B1
DATED : March 12, 2002
INVENTOR(S) : Fumito Nonaka

It is certified that error appears in the above-identified patent and that said Letters Patent is hereby corrected as shown below:

Column 11,
Line 47, "ing:" should read -- ing --.

Signed and Sealed this

Eighteenth Day of June, 2002

*Attest:*

*Attesting Officer*

JAMES E. ROGAN
*Director of the United States Patent and Trademark Office*